US008328254B1

(12) United States Patent
Zats

(10) Patent No.: US 8,328,254 B1
(45) Date of Patent: Dec. 11, 2012

(54) PORTABLE BALL RETRIEVER

(75) Inventor: Aleksey Zats, Fair Lawn, NJ (US)

(73) Assignee: Aleksey Zats, Fair Lawn, NJ (US)

( * ) Notice: Subject to any disclaimer, the term of this patent is extended or adjusted under 35 U.S.C. 154(b) by 0 days.

(21) Appl. No.: 13/475,650

(22) Filed: May 18, 2012

(51) Int. Cl.
*A63B 47/02* (2006.01)

(52) U.S. Cl. ..... 294/19.2

(58) Field of Classification Search ..... 294/19.2, 294/137, 170, 171, 158, 159; 206/315.9; 56/328.1, 332
See application file for complete search history.

(56) References Cited

U.S. PATENT DOCUMENTS

| | | | | | |
|---|---|---|---|---|---|
| 2,835,099 | A * | 5/1958 | Touchberry | 56/328.1 |
| 3,371,950 | A * | 3/1968 | Stap | 294/15 |
| 4,194,779 | A * | 3/1980 | Ouhashi | 294/19.2 |
| 4,412,697 | A * | 11/1983 | Verde | 294/19.2 |
| 4,461,504 | A * | 7/1984 | Perez et al. | 294/19.2 |
| 5,086,948 | A * | 2/1992 | Slusarz | 221/185 |
| 5,507,541 | A * | 4/1996 | Chen et al. | 294/19.2 |
| 5,738,401 | A * | 4/1998 | Fan | 294/171 |
| 6,142,544 | A * | 11/2000 | Benzoni et al. | 294/19.2 |
| 6,302,460 | B1 * | 10/2001 | Carr | 294/19.2 |
| 6,354,643 | B1 * | 3/2002 | Podejko | 294/19.2 |
| 6,926,328 | B2 * | 8/2005 | Hellerson | 294/19.2 |
| 6,945,578 | B2 * | 9/2005 | Hellerson | 294/19.2 |
| 8,141,919 | B2 * | 3/2012 | Turdo | 294/19.2 |
| 2011/0204664 | A1 * | 8/2011 | Turdo | 294/19.2 |

* cited by examiner

*Primary Examiner* — Saul Rodriguez
*Assistant Examiner* — Gabriela Puig

(57) ABSTRACT

A portable ball retriever utilized on a tennis court flat surface, comprising a container having a top handle, a logo plate, a body with an open top, top band, converging side wall, a retrieving bottom aperture with elongated wires spaced from each other a distance smaller than a tennis ball's diameter. The converging side wall has a waist located near the retrieving bottom aperture. The side wall converges inwardly from the open top to the waist and diverges outwardly from the waist to the retrieving bottom aperture. The top handle has spaced grips and the oriented vertically logo plate is placed in-between them. The spaced grips cover the upper and lower edges of the logo plate. The side wall protrudes above the top band and along with the top handle enlarges the container capacity.

13 Claims, 4 Drawing Sheets

PORTABLE BALL RETRIEVER

FIELD OF THE INVENTION

This invention relates to portable devices for efficient handling of tennis balls during practice on the tennis court.

BACKGROUND OF THE INVENTION

Tennis courts are relatively large. Tennis players and instructors use ball retrievers to minimize ball gathering time. Retrieving devices are utilized to collect dispensed tennis balls and to discharge them into carts, hoppers or ball machines.

Stap patented a portable tennis ball retriever in 1968, U.S. Pat. No. 3,371,950. He describes a tennis ball retriever and storage unit comprised of an upright wire basket with a top opening, a handle with a round grip mounted above the top opening, a retrieving bottom grate including parallel rods spaced from each other a distance smaller than a tennis ball's diameter, so as to define the space through which squeezed balls pushed against a tennis court flat surface enter and remain in the retriever. Retrieving procedure consists of placing the basket over a ball or a few balls, pushing it down and lifting the basket up with retrieved balls inside. The most recently retrieved balls push the previously retrieved balls up towards the top of the basket. This sequence is repeated until the basket gets full. Discharging procedure comprises tipping of the receptacle out of the upright position.

This compact wire basket has a simple prism shape. It is easy to use and inexpensive to manufacture. The device is light, reliable, and does not require bending over during the ball retrieval process.

When a considerable amount of balls is collected in the basket, it is difficult to push the basket down and collect additional balls. This is caused by the compression of soft tennis balls in between the parallel vertical side walls. Side wall reaction forces appear as a result of an insertion of incoming balls in-between balls previously residing in the basket. The large coefficient of friction between tennis balls contributes to significant resistance of the balls internal movement. An extensive friction force negatively affects retrieving and discharging procedures. The round grip handle does not provide the needed leverage to keep the basket from twisting and turning while retrieving balls. It requires extra time to accurately place the container 20 in the retrieving position. As a result, the basket with round grip handle is not efficient in the retrieval process.

Christina E. Turdo patented a nestable ball retrieval and storage device in 2012, U.S. Pat. No. 8,141,919. She describes a tennis ball retriever utilizing a similar structure, and similar retrieving and discharging procedures as the wire basket patented by Stap, but this receptacle includes slanted side walls and has pyramidal frustum shape. The receptacle wall structure has an open top and converges inwardly from the open top to the bottom grate to establish a tapered cavity.

This wire basket is easy to use. It is light, reliable, and does not require bending over during the ball retrieval process. The resistance force of balls entering and exiting the receptacle is reduced. The tapered down cavity side walls generate the resultant reaction force directed upwards. It eases balls movement toward the open top.

However, the tapered receptacle has some disadvantages in comparison with the prism shaped retriever. The tapered receptacle's bottom grate size has to be considerably smaller than the top size which is predetermined by storage ability.

The small size bottom grate would allow retrieving fewer balls at once. Moreover, the tapered retriever is inconvenient for collecting balls located next to an obstacle like a fence or a net, because when the top of the retriever is flush with such an obstacle, the bottom is tapered away. In such situations, the bottom edge cannot get behind the ball to retrieve it. These facts diminish the tapered receptacle's efficiency. In addition, this nestable ball retrieval and storage device has the same round grip handle issue as the retriever patented by Stap.

There are more retrievers with a tapered cavity described in U.S. Pat. Nos. 4,412,697; 6,945,578; 6,354,643; 6,302,460.

Commercially available light and compact wire baskets utilized as portable tennis ball retrievers have a pyramidal frustum shape and a handle with a round grip. They have a logo plate welded to a side wall. This plate is an obstruction in ball retrieving and discharging procedures. Furthermore, a logo plate made from thin sheet metal might have sharp edges. It is unsafe to use such devices especially for children, because their hands often go inside the device to speed up ball discharging. Commercially available lightest wire basket has the side wall with only twelve vertically oriented wires. It is compact, but has a small capacity. This retriever has a double rod bottom structure, which does not allow use of plastic rollers to protect the tennis court surface and the basket's integrity.

SUMMARY OF THE INVENTION

Objects of the invention are:

a) to provide a portable tennis ball retriever which will be efficient, light and compact;

b) to provide a portable tennis ball retriever which will be easy to use, reliable and inexpensive to manufacture;

c) to provide a portable tennis ball retriever which will be safe and convenient to use.

In accordance with the present invention, a portable tennis balls retriever utilized on a flat surface, comprising a container having a top handle, a logo plate, a body with an open top, converging side wall, a retrieving bottom aperture with elongated wires spaced from each other a distance smaller than the tennis ball diameter. The converging side wall has a waist located in-between the open top and the bottom aperture. The side wall converges inwardly from the open top to the waist and diverges outwardly from the waist to the retrieving bottom aperture. The top handle includes spaced grips and the logo plate is placed in-between spaced grips. The logo plate is oriented vertically and spaced grips cover the upper and lower edges of the logo plate. The side wall protrudes above the top band and along with the top handle enlarges the container capacity.

REFERENCE NUMERALS IN DRAWINGS

| | |
|---|---|
| 20 | container |
| 22 | body |
| 24 | top handle |
| 26 | logo plate |
| 28 | open top |
| 30 | side wall |
| 32 | retrieving bottom aperture |
| 34 | bottom wire |
| 36 | side wire |
| 38 | waist |
| 40 | upper grip |
| 42 | lower grip |
| 44 | front arm |
| 46 | rear arm |
| 48 | right panel |
| 50 | left panel |
| 52 | front roller wire |
| 54 | rear roller wire |
| 56 | top band |
| 58 | roller |
| 60 | center vertical axis |
| 62 | ball |
| 64 | flat surface |

DESCRIPTION OF THE INVENTION

Figure 1:
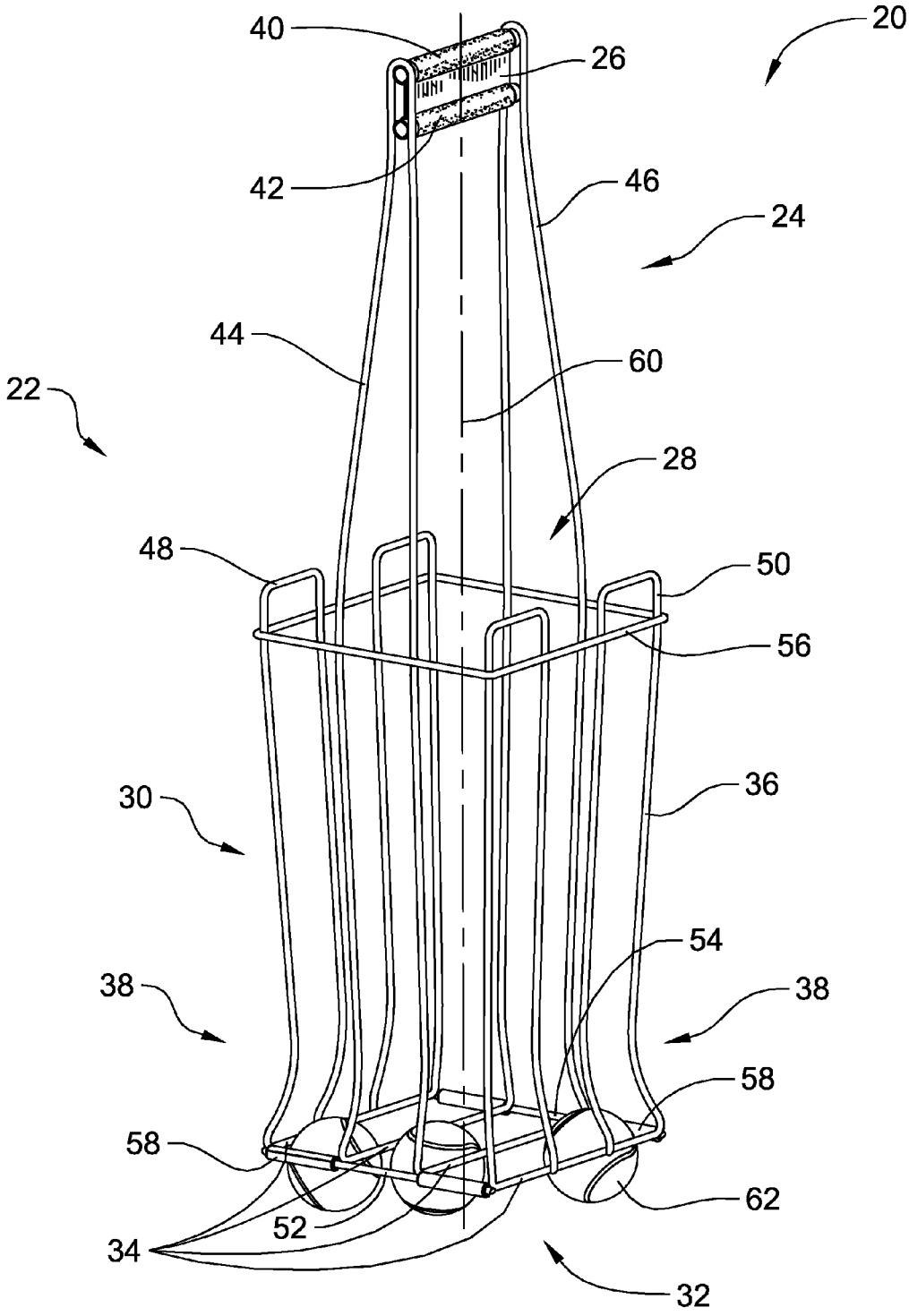
FIG. 1 is a perspective view of a portable ball retriever prior to collecting the first three balls.

A portable ball retriever is shown in perspective view on FIG. 1. It comprises a container 20 generally made from steel with a rust proof powder coating or from stainless steel. The container 20 includes a welded wire basket type body 22. The container 20 has a top handle 24, an open top 28, a side wall 30, or walls 30 and a retrieving bottom aperture 32. The retrieving bottom aperture 32 includes elongated four parallel bottom wires 34 spaced from each other a distance smaller than a tennis ball's diameter. The side wall 30 comprises vertically oriented side wires 36 and a waist 38. The top handle 24 has an upper grip 40, lower grip 42, a logo plate 26, front arm 44 and rear arm 46. Each arm has two vertically oriented wires. Distance between these wires is smaller than a ball's diameter. Handle arms 44 and 46 extend down to the retrieving bottom aperture 32. The converging side wall 30 is formed by the right panel 48, by the left panel 50, which are identical, and by the four vertically oriented handle wires. These parts are joined by the square shaped top band 56 at the open top 28 and by roller wires 52 and 54 at the retrieving bottom aperture 32. Two rollers 58 are installed on the front roller wire 52 and other two on the rear roller wire 54. The container 20 has a center vertical axis 60.

Figure 2:
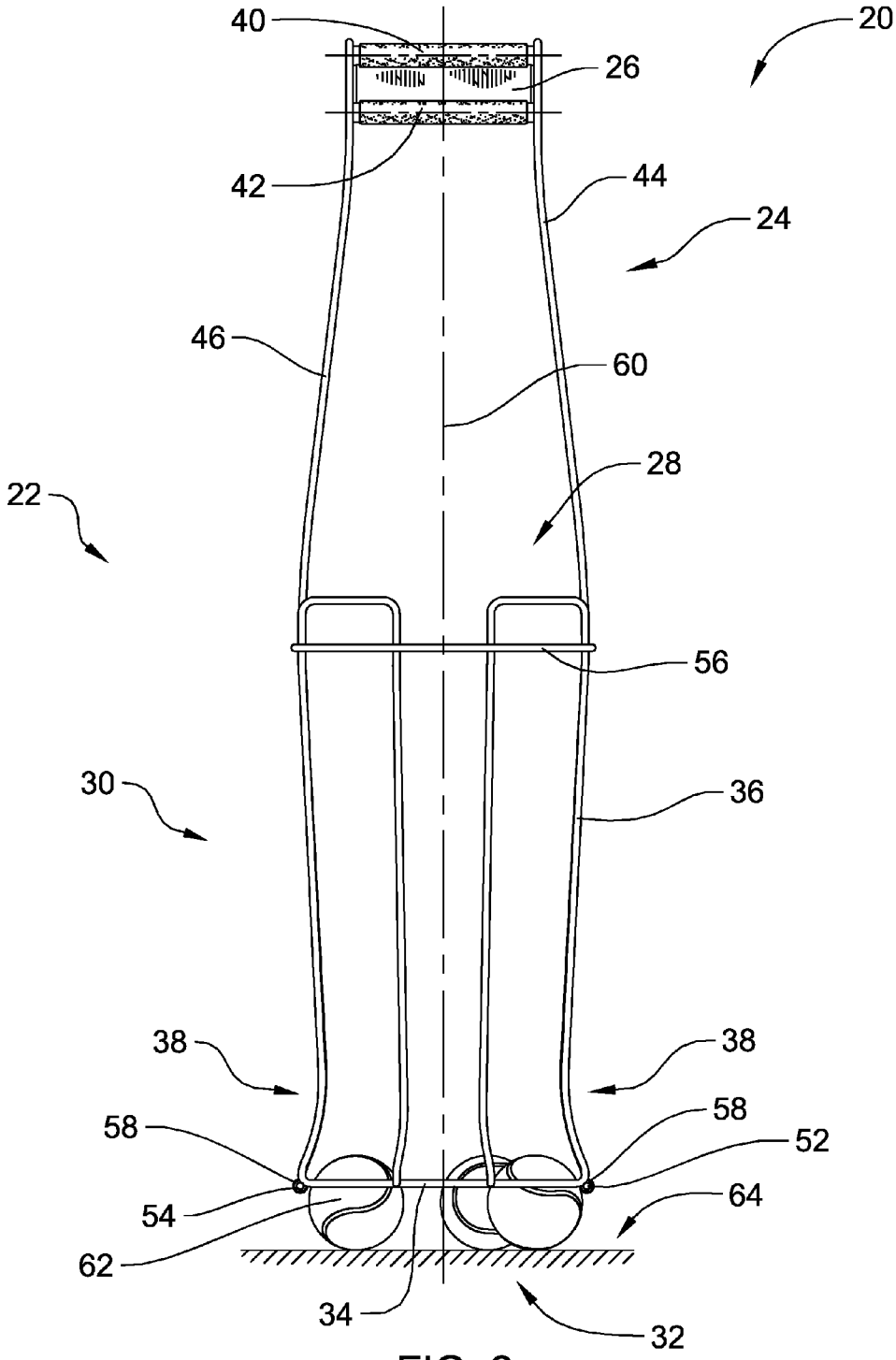
FIG. 2 is a right view of a portable ball retriever prior to collecting the first three balls.
Figure 3:
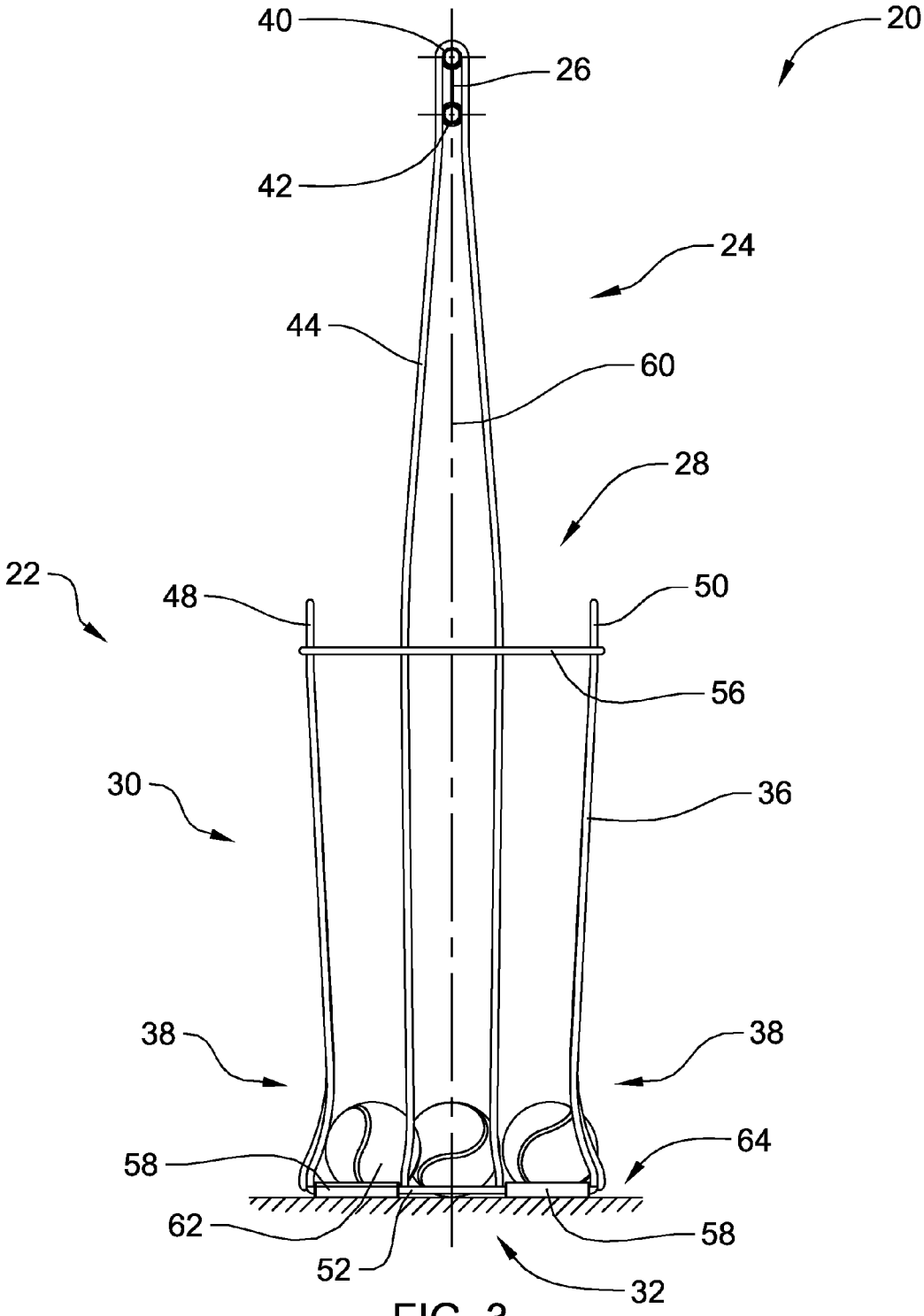
FIG. 3 is a front view of a portable ball retriever with the retrieved first three balls inside.
Figure 4:
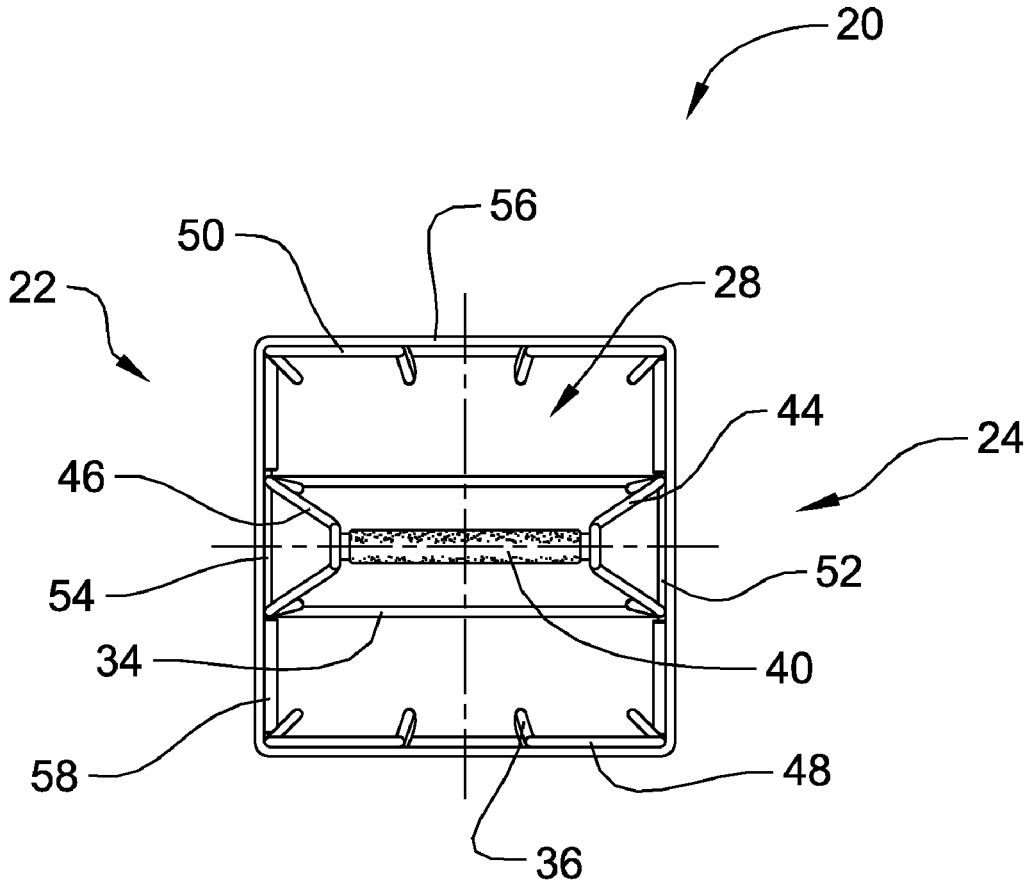
FIG. 4 is a top view of a portable ball retriever.

The container 20 side views FIG. 2 and FIG. 3 show the waist 38 located in-between the open top 28 and the retrieving bottom aperture 32. The side wall 30 converges inwardly from the open top 28 to the waist 38 and diverges outwardly from the waist 38 to the retrieving bottom aperture 32. The waist 38 circumference is smaller than the open top 28 circumference and the waist 38 circumference is smaller than the bottom aperture 32 circumference. At the waist 38 height, where the waist 38 circumference has a minimum length, side wires 36 are curved inwards in the direction of the center vertical axis 60 as shown on FIG. 1, FIG. 2, FIG. 3, and FIG. 4. Wires 36 diverge from the waist 38 towards the open top 28 and towards the retrieving bottom aperture 32, so the distance in-between wires 36 is the smallest at the waist height. The open top 28 and the retrieving bottom aperture 32 have the same square shape and are approximately the same size. The waist 38 is located near said retrieving bottom aperture 32. As shown on FIG. 1, FIG. 2 and FIG. 3 the upper grip 40 and the lower grip 42 are spaced from each other and the logo plate 26 is placed in-between them. The logo plate 26 is oriented vertically and the upper grip 40 covers an upper edge of the logo plate 26, the lower grip 42 covers a lower edge of the logo plate 26 and the handle arms 44 and 46 cover the logo plate 26 side edges. FIG. 1 and FIG. 3 show the grips 40 and 42 joined with the handle arms 44 and 46 and the logo plate 26 attached to the grips 40 and 42. In addition to branding, the logo plate 26 reinforces the top handle 24 structure. The logo plate 26 can be attached to the handle arms 44 and 46 as well, making the handle even stronger. Sturdy handle structure increases the container 20 reliability. Both grips have a rubber or plastic coating for effective and comfortable handling. As shown on FIG. 1, FIG. 2 and FIG. 3, the right panel 48 and the left panel 50 protrude above the top band 56 and along with the handle arms 44 and 46 keep the upper balls from falling out, because a distance between arms and panels and between protrusions is smaller than a ball's diameter. The roller 58 is replaceable. It is made from wear resistant plastic to protect the tennis court surface and the container 20 integrity.

To begin the retrieval process, a user lifts the upright oriented container 20 by the handle grips 40 and 42 and moves it towards the balls 62 laying on a tennis court flat surface 64. After reaching the balls, the user places the retrieving bottom aperture 32 above a ball 62 or a few balls to be collected as shown in FIG. 1 and FIG. 2. Next the user retrieves a ball 62 or a few balls by pushing the handle 28 down until rollers 58 touch the flat surface 64. The squeezed ball 62 or a few balls which are pressed against the flat surface 64 enter and remain in the container 20, as shown in FIG. 3. The user repeats the previous steps until the desired number of balls is retrieved, or until the container 20 gets full. Collected balls can be discharged by gravity from the upside-down oriented container 20 into a cart, a hopper or a ball machine.

Retrieved balls enter the tapered-in cavity and move up towards the narrow waist 38 as shown on FIG. 1, FIG. 2 and FIG. 3. Although the narrow waist 38 creates additional resistance, this resistance is insignificant because the narrow waist 38 is located near the retrieving bottom aperture 32. The narrow waist 38 begins to taper outwardly at a distance approximately the height of a tennis ball from the bottom aperture 32. The balls on the bottom layer experience minimal resistance, and easily move to make room for newly entering balls. Additionally, the narrow waist 38 causes the balls above it to create a bridging effect, diminishing pressure on the balls below and further easing the retrieval process. As a result, the container 20 requires the same small retrieving force typical to fully tapered receptacles. The container 20 with the enlarged retrieving bottom aperture 32 allows for retrieving more balls at once. The retriever is convenient for collecting balls located next to obstacles like a fence or a net, because the retrieving bottom aperture 32 and the open top 28 have the same shape and almost the same size. The top and the bottom edges are vertically aligned to allow the bottom edge to get closer to an obstacle and behind the ball without the top touching that obstacle. The handle with spaced grips gives the user good leverage to control the container's 20 swinging and turning during the retrieval process. The user's wrist and thumb hold the upper grip 40 and the other fingers hold the lower grip 42. The leverage or the moment of holding force is proportional to the distance between the upper grip 40 and the lower grip 42. Improved handle leverage minimizes the time required to move the container 20 from one retrieving position into another. The right panel 48 and the left panel 50 protruded above the top band 56 and along with the handle arms 44 and 46 considerably enlarge the container 20 capacity, but add weight insignificantly. The container 20 has a simple structure. The side wall includes only twelve vertically oriented wires. The container 20 allows using rollers 58 made to protect a tennis court surface and the container 20 integrity.

The described portable ball retriever is an improvement over the prior-art and upon currently existing models. It has all the advantages of the prism and the pyramidal frustum shape receptacles. At the same time, it is compact and efficient for retrieving and discharging reasonable amount of tennis balls. This concept was verified by testing the full scale prototype. All results were positive. Balls were easy to collect and to discharge in different conditions. The handle is convenient and robust and gives sufficient leverage for fast container relocation and ball retrieval. This portable ball retriever is efficient, safe, compact, simple and convenient to use.

The presented embodiment should not be interpreted as limiting the scope of this invention. For example, the container open top can have other shapes such as rectangular, circular or trapezoidal and one side wall or a few side walls may include a waist. Thus, the scope of the invention should be determined by the appended claims and their legal equivalents.

I claim:

1. A portable ball retriever utilized on a flat surface, comprising:

a container having a top handle, a body with an open top, a converging side wall, a retrieving bottom aperture with elongated members spaced from each other a distance smaller than a ball's diameter, so as to define a space through which squeezed balls pushed against said flat surface enter and remain in the container, wherein said converging side wall has a waist located in-between said open top and said retrieving bottom aperture, whereby said converging side wall converges inwardly from said open top to said waist and diverges outwardly from said waist to said retrieving bottom aperture.

2. The retriever of claim 1, wherein said waist circumference is smaller than said open top circumference and said waist circumference is smaller than said bottom aperture circumference.

3. The retriever of claim 1, wherein said container further including a center vertical axis, said side wall further including vertically oriented wires and at said waist height said vertically oriented wires are curved inwards in the direction of said center vertical axis.

4. The retriever of claim 1, wherein said vertically oriented wires diverge from said waist towards said open top and towards said retrieving bottom aperture.

5. The retriever of claim 1, wherein said open top and said retrieving bottom aperture have the same shape and about the same size.

6. The retriever of claim 1, wherein said waist is located near said retrieving bottom aperture.

7. A portable ball retriever utilized on a flat surface, comprising:

a container having a top handle, a logo plate, a body with an open top, side wall, a retrieving bottom aperture with elongated members spaced from each other a distance smaller than a ball's diameter, so as to define a space through which squeezed balls pushed against said flat surface enter and remain in the container, wherein said top handle includes spaced grips, whereby said logo plate is placed in-between said spaced grips and wherein said logo plate is oriented vertically and said spaced grips cover an upper edge and a lower edge of said logo plate.

8. The retriever of claim 7, wherein said top handle including a front arm and a rear arm and said logo plate side edges are covered by said front arm and said rear arm.

9. The retriever of claim 7, wherein said logo plate is a part of said top handle structure.

10. A portable ball retriever utilized on a flat surface, comprising:

a container having a body with an open top, top band, side wall, a retrieving bottom aperture with elongated members spaced from each other a distance smaller than a ball's diameter, so as to define a space through which squeezed balls pushed against said flat surface enter and remain in the container, a top handle with a front arm and a rear arm, wherein said container includes right panel, left panel, roller rods, said arms extend down to said retrieving bottom aperture, said panels and said arms are joined together by said top band at said open top and by said roller rods at said retrieving bottom aperture, whereby said panels protrude above said top band and distance between each said arm and every said panel is smaller than a ball's diameter.

11. The retriever of claim 10, wherein each said arm has two vertically oriented wires and distance between these wires is smaller than a ball's diameter.

12. The retriever of claim 10, wherein said top band has a square shape.

13. The retriever of claim 10, further including rollers installed on said roller rods.

* * * * *